US007887351B2

(12) United States Patent
Wang et al.

(10) Patent No.: US 7,887,351 B2
(45) Date of Patent: Feb. 15, 2011

(54) ELECTRICAL CONNECTOR FOR FLAT CONDUCTOR

(75) Inventors: Shing-Sheng Wang, Taipei County (TW); Yen-Lin Chen, Taipei County (TW)

(73) Assignee: Taiwan Suncagey Industrial Co., Ltd., Taipei County (TW)

( * ) Notice: Subject to any disclaimer, the term of this patent is extended or adjusted under 35 U.S.C. 154(b) by 0 days.

(21) Appl. No.: 12/290,344

(22) Filed: Oct. 30, 2008

(65) Prior Publication Data

US 2010/0261375 A1 Oct. 14, 2010

(51) Int. Cl.
*H01R 13/15* (2006.01)
*H01R 13/62* (2006.01)

(52) U.S. Cl. ..... 439/260; 439/261; 439/495

(58) Field of Classification Search ..... 439/260, 439/261, 495; D13/147
See application file for complete search history.

(56) References Cited

U.S. PATENT DOCUMENTS 6,042,410 A * 3/2000 Watanabe ..... 439/269.1
6,089,905 A * 7/2000 Shimmyo et al. ..... 439/495
6,949,316 B2 * 9/2005 Aoki ..... 439/260
7,083,455 B1 * 8/2006 Miura et al. ..... 439/260
D531,126 S * 10/2006 Suzuki et al. ..... D13/147
7,179,118 B1 * 2/2007 Harlan et al. ..... 439/495
7,435,122 B2 * 10/2008 Suzuki et al. ..... 439/260
2002/0106924 A1 * 8/2002 Uehara ..... 439/260
2006/0084311 A1 * 4/2006 Suzuki et al. ..... 439/260
2006/0292911 A1 * 12/2006 Ning ..... 439/260

* cited by examiner

*Primary Examiner*—Hae Moon Hyeon
(74) *Attorney, Agent, or Firm*—Leong C. Lei

(57) ABSTRACT

An electrical connector for a flat conductor that has a novel positioning and retaining structure is disclosed. The electrical connector comprises a housing, a pressure member and a plurality of conductive terminals spaced with a certain interval and planted onto the housing. The electrical connector is characterized in a pair of prominences internally molded at two sides of a lower surface of the pressure member, and another pair of protrusions internally molded at two inner lateral walls of the housing near a front edge of the housing, namely the edge receiving the flat conductor. Thereby, when the flat conductor is inserted into the electrical connector, the flat conductor is firstly positioned by the protrusions of the housing, and then when the pressure member is closed to the housing, the flat conductor is engaged with the prominences of the pressure member.

1 Claim, 4 Drawing Sheets

ELECTRICAL CONNECTOR FOR FLAT CONDUCTOR

BACKGROUND OF THE INVENTION

1. Technical Field

The present invention relates to electrical connectors for flat conductors, and more particularly, to an electrical connector for a flat conductor, wherein the flat conductor is firstly positioned when it is inserted into the electrical connector and then the flat conductor is securely fixed therein.

2. Description of Related Art

A known electrical connector for a flat conductor, taking Taiwan Patent 1251967 for example, is provided with hooks that are integrally molded on inner surfaces of a housing of the electrical connector for engaging a flat conductor in place, requiring structurally complex molds that render high product defect rate and in turn cause high manufacturing costs. Such known electrical connector is also equipped with a receiving recess formed in the housing and a metal component that has hooks and is affixed into the receiving recess, so it is necessary to prepare at least one additional mold for the metal component and provide additional process as well as costs to assemble the metal component. Furthermore, when a pressure member of the electrical connector is lifted and the flat conductor held therein is about to be removed, the hooks remain engaging the flat conductor so that the flat conductor retained by the hooks can not be removed facilely.

SUMMARY OF THE INVENTION

One objective of the present invention is to provide an electrical connector for a flat conductor, wherein the flat conductor is firstly positioned when it is inserted into the electrical connector and then the flat conductor is secured therein.

To achieve the objective of the present invention, the disclosed electrical connector has a pair of prominences formed at two sides of a lower surface of the pressure member, and another pair of protrusions internally formed at two inner lateral walls of the housing near a front edge of the housing, namely the edge receiving the flat conductor. Thereby, when the flat conductor is inserted into the electrical connector, the flat conductor is firstly positioned by the protrusions of the housing, and then when the pressure member is closed to the housing, the flat conductor is firmly engaged with the prominences of the pressure member.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein.

DETAILED DESCRIPTION OF THE PREFERRED EMBODIMENTS

Figure 1:
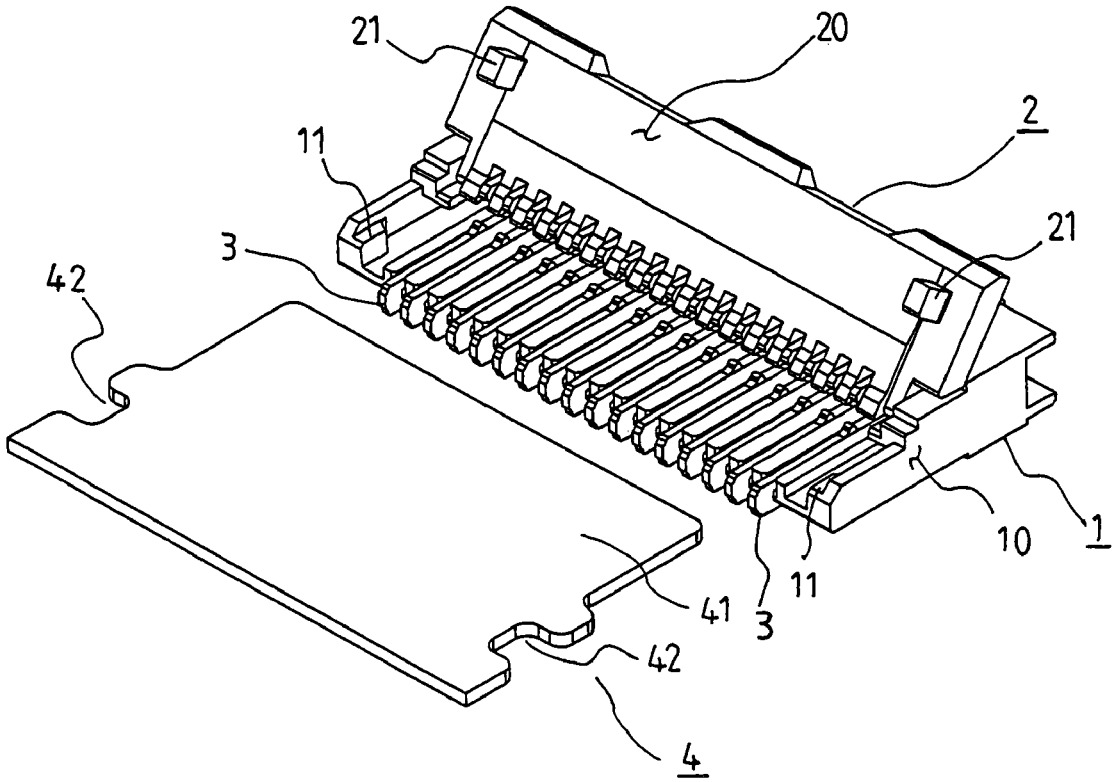
FIG. 1 is a schematic drawing showing an electrical connector for a flat conductor of the present invention having a pressure member thereof lifted for receiving a flat conductor to be inserted therein.
Figure 2:
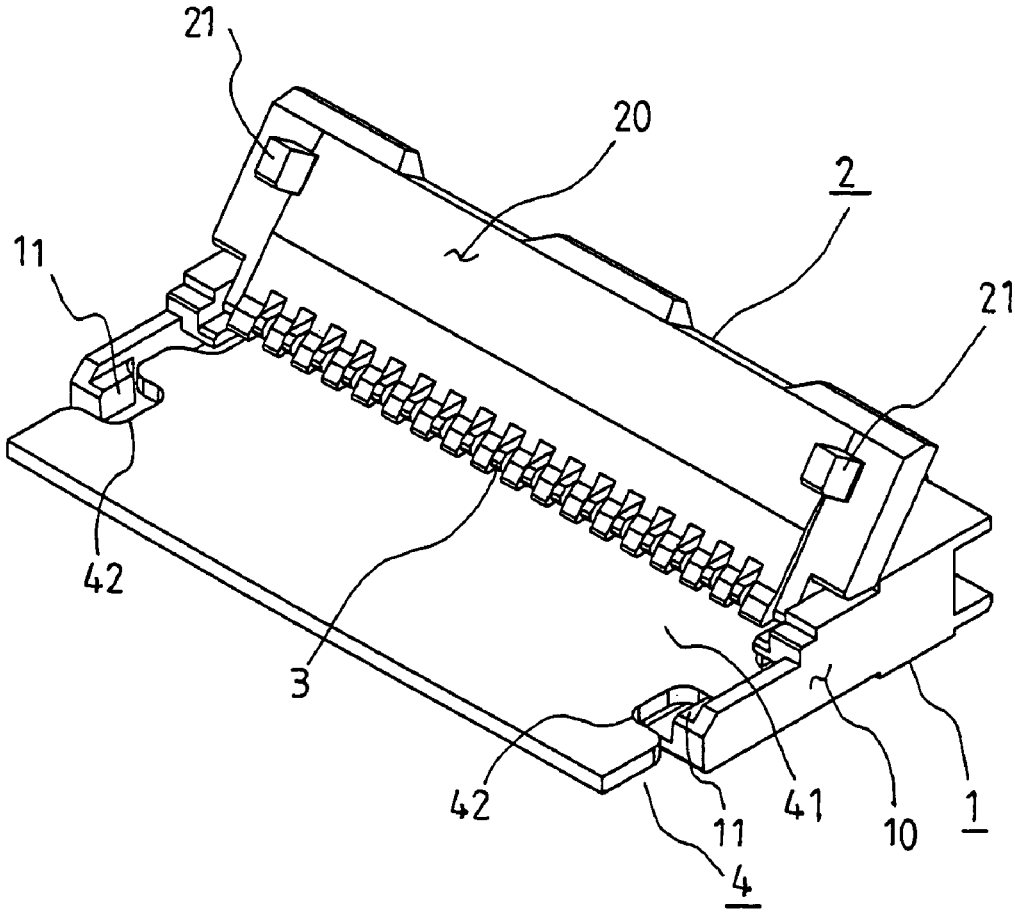
FIG. 2 is a perspective view of the electrical connector holding the flat conductor according to the present invention with its pressure member lifted.
Figure 3:
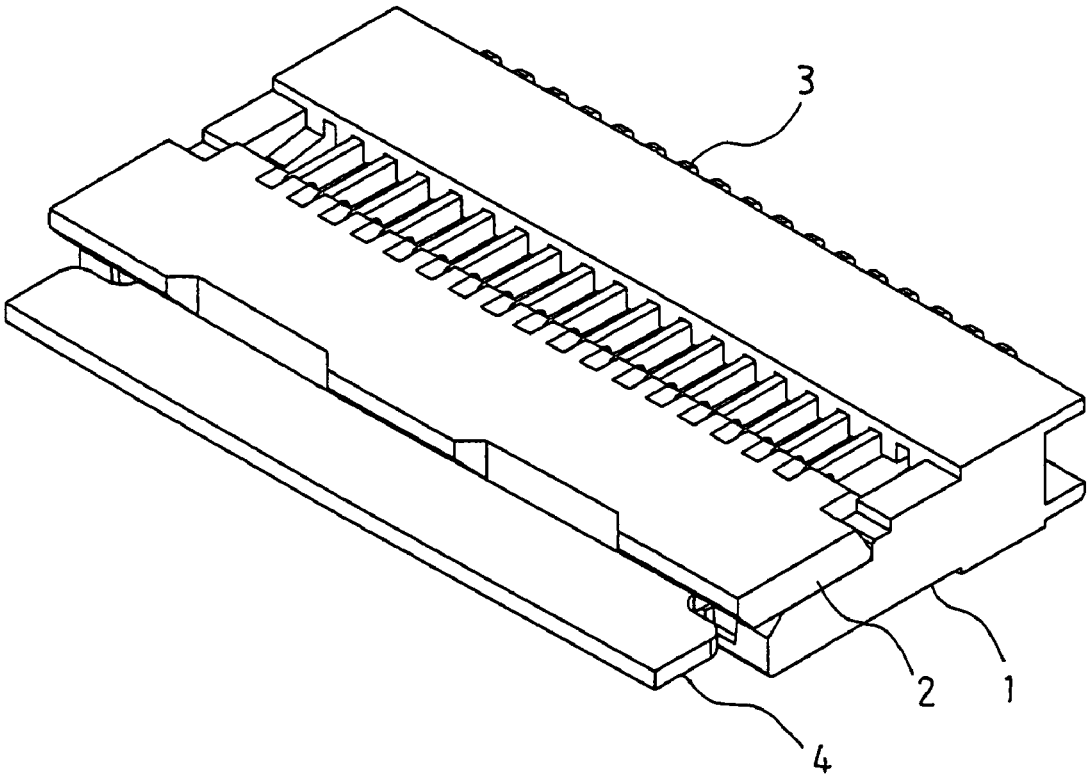
FIG. 3 is another perspective view of the electrical connector holding the flat conductor according to the present invention with its pressure member closed to retain the flat conductor.
Figure 4:
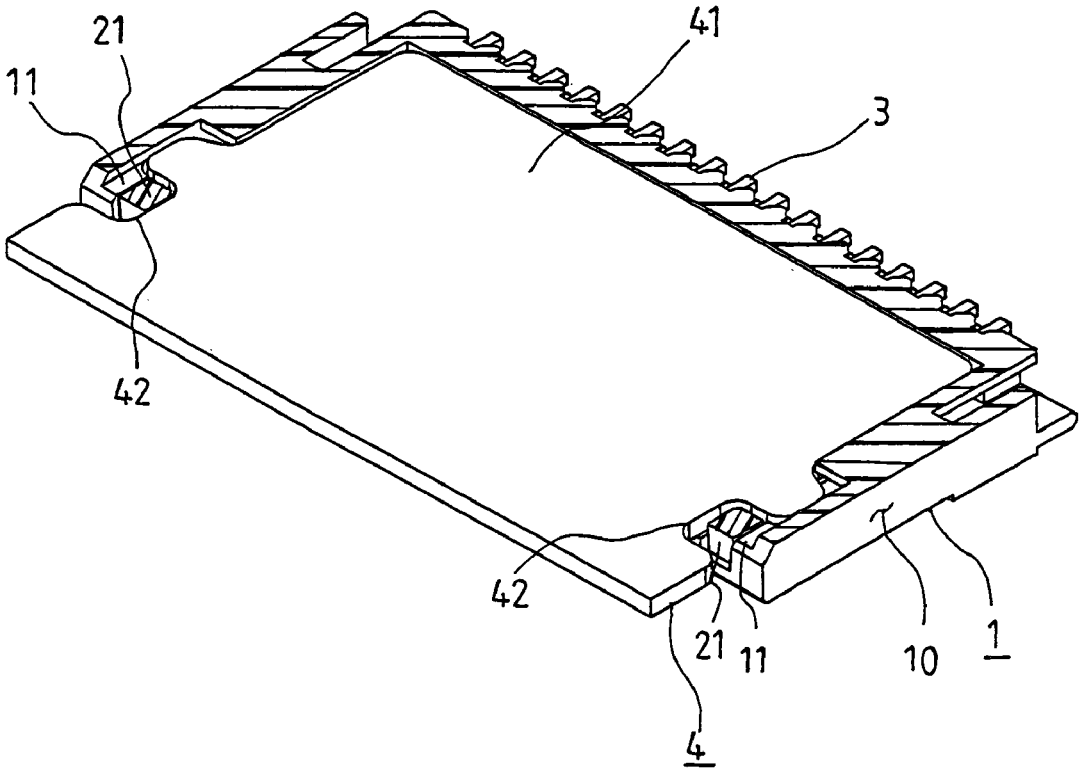
FIG. 4 is a perspective sectional view of the electrical connector holding the flat conductor according to the present invention with its pressure member closed to retain the flat conductor.

Referring to FIG. 1, similar to the aforesaid prior art device, an electrical connector for a flat conductor of the present invention is primarily composed of a housing 1, a pressure member 2 and a plurality of conductive terminals 3 spaced with a certain interval and planted onto the housing 1. However, the electrical connector of the present invention is characterized in that a pair of prominences 21 are internally molded at two sides of a lower surface of a body 20 of the pressure member 2, respectively, and another pair of protrusions 11 are internally molded at two inner lateral walls of a body 10 of the housing 1 near a front edge that receives a flat conductor, respectively. Thereby, when a flat conductor 4 is to be inserted into the disclosed electrical connector, as shown in FIG. 2, the flat conductor 4 has two notches 42 formed near its inserting end 41 aligned with the protrusions 11 at the two inner lateral walls of the body 10 of the housing 1 and then comes into conductively connection with the terminals 3 in the housing 1. Afterward, as shown in FIG. 3, the pressure member 2 is closed to the housing 1 so as to not only provide the conventional function of retaining the flat conductor 4 by the body 20 of the pressure member 2, but also further position the flat conductor 4 by having the prominences 21 molded at the two sides of a lower surface of the pressure member 2 engaged with the two notches 42 formed near the inserting end 41 of the flat conductor 4, thereby firmly retaining the flat conductor 4 in the housing 1.

Moreover, the protrusions 11 at the two inner lateral walls of the body 10 of the housing 1 only serve to "pre-position" the flat conductor 4 when the electrical connector receives the flat conductor, but the protrusions 11 do not get engaged with the two notches 42 formed near the inserting end 41 of the flat conductor 4. Therefore, when the pressure member 2 is lifted and the prominences 21 on the body 20 leave the two notches 42, the inserting end 41 of the flat conductor 4 is completely free from engagement so that the inserting end 41 of the flat conductor 4 can be facilely removed from the electrical connector without obstruction.

In an alternative embodiment (not shown in the drawings), since the body 10 of the housing 1 of the electrical connector is designed to match the inserting end 41 of the flat conductor 4 in width, only one prominence 21 molded at the lower surface of the body 20 of the pressure member 2 and only one protrusion 11 provided at one inner lateral wall of the body 10 of the housing 1 are sufficiently effective to position the flat conductor 4 and retain the flat conductor 4 firmly when the pressure member 2 is closed to the housing 1.

The invention claimed is:

1. An electrical connector for a flat conductor, said electrical connector comprising a housing, a pressure member, and a plurality of conductive terminals spaced with an interval and planted onto the housing, wherein said electrical connector further comprising:

two prominences provided at two sides of a lower surface of the pressure member; and two protrusions provided at two inner lateral walls of the housing near a front edge that receives the flat conductor, the two protrusions being spaced laterally outwardly from the two prominences;

wherein the pressure member is pivotally mounted on the housing, the two prominences are movable toward and away from the two protrusions, the flat conductor has a notch on each side for receiving the protrusions of the lateral walls of the housing, the two protrusions being spaced from and out of contact with the flat conductor when the conductor is inserted into the housing, and the two prominences are received in the notches of the flat conductor when the pressure member is pivoted to a closed position.

* * * * *